US008555985B2

(12) United States Patent
Metcalfe

(10) Patent No.: US 8,555,985 B2
(45) Date of Patent: Oct. 15, 2013

(54) PERMEABILITY MODIFICATION

(76) Inventor: Paul David Metcalfe, Colby (GB)

( * ) Notice: Subject to any disclaimer, the term of this patent is extended or adjusted under 35 U.S.C. 154(b) by 167 days.

(21) Appl. No.: 12/666,942

(22) PCT Filed: Jun. 25, 2008

(86) PCT No.: PCT/GB2008/002158

§ 371 (c)(1),
(2), (4) Date: Dec. 28, 2009

(87) PCT Pub. No.: WO2009/001069

PCT Pub. Date: Dec. 31, 2008

(65) Prior Publication Data

US 2010/0175895 A1 Jul. 15, 2010

(30) Foreign Application Priority Data

Jun. 26, 2007 (GB) ..... 0712345.8

(51) Int. Cl.
*E21B 23/00* (2006.01)

(52) U.S. Cl.
USPC ..... 166/382; 166/228

(58) Field of Classification Search
USPC ..... 166/133, 382, 235, 228, 276
See application file for complete search history.

(56) References Cited

U.S. PATENT DOCUMENTS

| | | | | |
|---|---|---|---|---|
| 2,603,293 | A * | 7/1952 | Lynes | 166/116 |
| 2,611,437 | A * | 9/1952 | Lynes | 277/334 |
| 3,915,227 | A | 10/1975 | Simpson | |
| 4,260,016 | A * | 4/1981 | Calderon | 166/74 |
| 4,770,256 | A | 9/1988 | Lipsker et al. | |
| 4,834,181 | A | 5/1989 | Uhri et al. | |
| 4,967,846 | A | 11/1990 | Wood | |
| 5,826,660 | A | 10/1998 | Rytlewski | |
| 5,896,928 | A * | 4/1999 | Coon | 166/373 |
| 6,026,900 | A | 2/2000 | Keller | |
| 6,315,040 | B1 | 11/2001 | Donnelly | |
| 6,457,518 | B1 * | 10/2002 | Castano-Mears et al. | 166/207 |
| 6,510,896 | B2 * | 1/2003 | Bode et al. | 166/276 |
| 7,036,600 | B2 | 5/2006 | Johnson et al. | |
| 2001/0039711 | A1 | 11/2001 | Donnelly et al. | |
| 2002/0088744 | A1 | 7/2002 | Echols et al. | |

(Continued)

FOREIGN PATENT DOCUMENTS

| | | |
|---|---|---|
| EP | 0 952 305 | 10/1999 |
| EP | 0 999 342 A2 | 5/2000 |

(Continued)

OTHER PUBLICATIONS

Bellingacci, F., European Patent Examiner's Report for corresponding European patent application No. 08 762 467.2, dated May 10, 2010.

(Continued)

*Primary Examiner* — Giovanna Wright
*Assistant Examiner* — Ronald Runyan
(74) *Attorney, Agent, or Firm* — Sutton McAughan Deaver, PLLC

(57) ABSTRACT

Downhole apparatus for location in a bore which intersects a fluid-producing formation comprises a bore wall-supporting member configurable to provide and maintain a bore wall supporting force for a fluid-producing formation of at least 2 MPa, whereby fluid may flow from the formation into the bore. The bore wall supporting force may be utilized to modify or maintain the permeability of the rock adjacent the bore wall.

23 Claims, 11 Drawing Sheets

(56) References Cited

U.S. PATENT DOCUMENTS

| | | | | |
|---|---|---|---|---|
| 2002/0092654 | A1* | 7/2002 | Coronado et al. | 166/369 |
| 2002/0107562 | A1 | 8/2002 | Hart et al. | |
| 2003/0196820 | A1 | 10/2003 | Patel | |
| 2003/0234111 | A1 | 12/2003 | Echols et al. | |
| 2004/0055758 | A1 | 3/2004 | Brezinski et al. | |
| 2004/0238168 | A1 | 12/2004 | Echols | |
| 2004/0261994 | A1 | 12/2004 | Nguyen et al. | |
| 2005/0016740 | A1 | 1/2005 | Aldaz et al. | |
| 2005/0072579 | A1 | 4/2005 | Gambier | |
| 2005/0098324 | A1 | 5/2005 | Gano | |
| 2005/0109517 | A1 | 5/2005 | Spray | |
| 2005/0139394 | A1 | 6/2005 | Maurer et al. | |
| 2005/0155773 | A1 | 7/2005 | Wetzel et al. | |
| 2005/0217860 | A1 | 10/2005 | Mack et al. | |
| 2006/0090903 | A1 | 5/2006 | Gano et al. | |
| 2007/0089886 | A1 | 4/2007 | Orban et al. | |
| 2007/0089909 | A1* | 4/2007 | Freeman | 175/57 |
| 2007/0227724 | A1* | 10/2007 | Saltel | 166/187 |
| 2008/0142219 | A1 | 6/2008 | Steele et al. | |
| 2009/0151942 | A1 | 6/2009 | Bernardi, Jr. | |
| 2009/0166040 | A1 | 7/2009 | Cavender et al. | |

FOREIGN PATENT DOCUMENTS

| | | | |
|---|---|---|---|
| EP | 1 096 104 | A1 | 5/2001 |
| EP | 1 152 120 | A2 | 11/2001 |
| EP | 1 840 324 | A1 | 10/2007 |
| GB | 735749 | B | 8/1955 |
| GB | 1 378 596 | A | 2/1972 |
| GB | 2 048 340 | | 12/1980 |
| GB | 2368082 | B | 5/2003 |
| GB | 2 388 387 | A | 11/2003 |
| GB | 2 398 582 | A | 8/2004 |
| GB | 2 399 368 | A | 9/2004 |
| GB | 2404683 | B | 3/2005 |
| GB | 2 410 267 | A | 7/2005 |
| GB | 2 411 918 | A | 9/2005 |
| GB | 2 423 321 | A | 8/2006 |
| JP | 2001-173600 | A | 6/2001 |
| WO | 99/25951 | A1 | 5/1999 |
| WO | 99/45236 | A1 | 9/1999 |
| WO | 00/01926 | A1 | 1/2000 |
| WO | 03/100211 | A1 | 12/2003 |
| WO | 2007/017836 | A1 | 2/2007 |
| WO | 2007017836 | | 2/2007 |
| WO | 2009/001069 | A2 | 12/2008 |
| WO | 2010/083166 | A2 | 7/2010 |
| WO | 2012/066290 | A3 | 5/2012 |

OTHER PUBLICATIONS

Bellingacci, F., European Patent Examiner's Report for corresponding European patent application No. 08 762 467.2, dated Apr. 12, 2011.

Bellingacci, F., European Patent Examiner's Report for corresponding European patent application No. 08 762 472.2, dated Apr. 12, 2011.

Bellingacci, F., European Patent Examiner's Search Report for corresponding European patent application No. 10 01 3413.9, dated Apr. 14, 2011.

Bellingacci, F., European Patent Examiner's Search Report for corresponding European patent application No. 10 01 3810.6, dated Apr. 14, 2011.

Bellingacci, F., European Patent Examiner's Search Report for corresponding European patent application No. 10 01 3628.2, dated Apr. 14, 2011.

Bellingacci, F., European Patent Examiner's Search Report for corresponding European patent application No. 10 01 3414.7, dated Apr. 14, 2011.

Pyatakhin, M., "Super Well with Stressed Screen", Vniigaz Gazprom, 23rd World Gas Conference, Amsterdam, Jun. 5-9, 2006, [retrieved from the Internet on Jul. 10, 2011 using <URL: http://kgu.or.kr/data/inter_conference.html?md=view&tb=bbs_017&no=3815&gubun=17&refer=%2Fdata%2Finter_conference.html%3Fgubun%3D17%26page%3D25>].

Pyatakhin, M., "Super Well with Stressed Screen", Scientific-Research Institute of Natural Gases and Gas Technologies, 23rd World Gas Conference, Amsterdam, 2006, [retrieved from the Internet on Jul. 10, 2011 using <URL: http://igu.org/html/wgc2006/pdf/paper/add10428.pdf>].

International Search Report for corresponding International Patent Application No. PCT/GB2008/002158.

International Search Report for related International Patent Application No. PCT/GB2008/002165.

A. Nouri, et al., "A Laboratory Study of the Effect of Installation of Reticulated Expandable Liners on Sand Production in Weakly Consolidated Sandstone Formations", SPE 96151 (Oct. 9, 2005-Oct. 12, 2005), pp. 1-10 (2005).

Wong, T-F. and Zhu, W., "Brittle Faulting and Permeability Evolution: Hydromechanical Measurement, Microstructural Observation, and Network Modeling", in Faults and Subsurface Fluid Flow in the Shallow Crust—Geophysical Monograph Series 113, W.C. Haneberg, P.S. Mozley, J.C. Moore, and L. B. Goodwin, Eds., American Geophysical Union (Publisher), Washington, D.C.; pp. 83-99 (1999).

Ewy, Russell T., et al., "Wellbore Stability Predictions Using a Modified Lade Criterion", SPE/ISRM 47251 (Jul. 8-10, 1996), pp. 247-254 (1996).

Jones, C. and Smart, B.G.D., "Stress Induced Changes in Two-Phase Permeability", SPE/ISRM 78155 (Oct. 20-23, 2002), pp. 1-9 (2002).

Keaney, G.M.; Meredith, P.; Murrell, S.; and Barker, J., "Determination of the Effective Stress Laws for Permeability and Specific Storage in a Low Porosity Sandstone.", ARMA/NARMS Paper No. 04-535, 2004.

Klimentos, T.; Harouaka, A.; Mtawaa, B.; and Saner, S., "Experimental Determination of the Biot Elastic Constant: Applications in Formation Evaluation (Sonic Porosity, Rock Strength, Earth Stresses and Sanding Predictions)", SPE Paper No. 30593, pp. 673-687 (1995).

Jones, C.; Smart, B.G.D., "Stress Induced Changes in Two-Phase Permeability", SPE/ISRM Paper No. 78155, pp. 1-9 (2002).

Hofmann, R.; Xu, X.; Batzle, M.; and Tshering, T., "Which Effective Pressure Coefficient Do You Mean?", SEG Technical Program Expanded Abstracts 23, pp. 1766-1769 (2004).

Keaney, G.M.J.; Meredith, P.G.; and Murrell, S.A.F., "Laboratory Study of Permeability Evolution in 'Tight' Sandstone under Non-Hydrostatic Stress Conditions", SPE/ISRM Paper No. 47265, pp. 329-335 (1998).

Wong, T-F.; and Zhu, W., "Brittle Faulting and Permeability Evolution: Hydromechanical Measurement, Microstructural Observation, and Network Modeling", in Geophysical Monograph 113: Faults and Subsurface Fluid Flow in the Shallow Crust, pp. 83-99 (1999).

Great Britain Intellectual Property Office Search Report for claims 1-127 of Application No. GB1019358.9, dated Jan. 31, 2011.

* cited by examiner (P1) > (P2)

PERMEABILITY MODIFICATION

CROSS REFERENCE TO RELATED APPLICATIONS

The present application is a National Stage Application under 35 U.S.C. §371 of International Application No. PCT/GB2008/002158, filed Jun. 25, 2008, which claims priority to Great Britain Patent Application Serial No. 0712345.8, filed Jun. 26, 2007, the contents of all of which are incorporated herein by reference.

FIELD OF THE INVENTION

This invention relates to downhole apparatus, and to a method of utilising the apparatus. Aspects of the invention relate to a bore-lining tubular which supports the wall of a drilled bore intersecting a fluid-bearing formation, to facilitate production of fluid from the formation. The apparatus may be utilised to modify or maintain the permeability of rock adjacent the wall of the bore.

BACKGROUND OF THE INVENTION

In modern wells, typically used for the exploitation of underground fluid reserves, a tubular bore lining, known as a completion, must be installed to support the wellbore throughout the life of the well. The completion may be required to allow controlled flow of reserves from several discrete reservoir sections.

Following drilling of a wellbore through a sandstone reservoir, it is often a requirement that the borehole be completed with a device that retains the sand particles in the reservoir, yet allows the hydrocarbons or water to be produced to surface with a generally low solids content. Several methods exist for "sand control". Such methods have been continuously developed since commercial exploitation of underground hydrocarbon resources began over 100 years ago.

At present in the energy and water industries, the accepted best practice is to install a sand control device that provides support to the wellbore face. Perhaps the oldest technique for providing support to the wellbore face is the placement of loose gravel around a rigid sand screen filter, otherwise known as gravel-packing (GP). If placed correctly, the gravel can completely fill the annular void between the screen and the borehole wall, maximizing support.

More recently devices have been developed to provide wellbore support without the need to pump gravel between the screen and the wellbore face. So-called expandable completions (EXP) rely on the plastic yielding of a tubular member to increase its diameter therefore minimizing or eliminating the annular void.

Both GP and EXP completions are operationally intensive activities. In the case of GP, several thousand barrels of specialized completion fluids and hundreds of tonnes of gravel must be prepared and pumped downhole to fill the void in a modern horizontal well. Such wells may exceed 4000 ft of reservoir penetration, traversing several rock types and of infinitely varying properties. If the operation is interrupted due to an equipment failure at surface, or because the rock characteristics are different to those assumed, the entire job could fail, resulting at best in a sub-optimal completion and at worst, with the well being lost. The equipment required to pump large GP treatments in modern wells requires capitally intensive investment. In the case of remote offshore wells, dedicated boats may be required to be built to support the operation. Tens of service personnel maybe required to effect a GP installation. Accordingly, this is expensive and in times of high activity may result in jobs being postponed until enough skilled labour is available. It is not uncommon for GP treatments in horizontal wells to cost several million US dollars per well.

In addition to sand control requirements, reservoirs may need to be divided up into discrete pressure containing zones. In this case the completion must facilitate the isolation of one zone from another with a potential differential pressure across zones. Such isolation becomes difficult when it must be combined with sand control. This is especially the case with GP and is one driver for the development of EXP completions with integral zonal isolation. Zonal isolation takes many forms: open hole, between casings or behind casing and achieving isolation correctly and economically is still an important aspect of well design. More recently, swelling elastomers have been developed as an oil-field method of achieving zonal isolation.

SUMMARY OF THE INVENTION

According to a first aspect of the present invention there is provided a downhole apparatus comprising a base pipe and a plurality of non-concentric fluid pressure deformable chambers mounted externally thereon.

According to another aspect of the present invention there is provided a method of lining a bore, the method comprising: providing downhole apparatus comprising a base pipe and a plurality of non-concentric fluid pressure deformable chambers mounted externally thereon; and inflating the chambers to increase the diameter described by the apparatus.

The chambers may take any appropriate form and be formed or defined by any appropriate material or structure. In certain embodiments the chambers may comprise metal-walled members, which may be in the form of tubes or other hollow members, for example steel tubes. In other embodiments, additional or alternative materials may be utilised to form the walls of the members. The members may fit snugly around the base pipe, may be spaced apart or may sit together at some points and be spaced apart at others. A wall of the chamber may have been previously deformed from a first configuration to a second configuration, whereby inflation tends to urge the walls to return to the first configuration or to take some other configuration. These changes in form may be achieved without substantially changing the length or circumference of the chamber wall. For example a generally cylindrical or tubular member may be deformed, subsequent inflation of the member urging the member to return towards a cylindrical or tubular configuration. The initial deformation may be achieved by any appropriate method, such as evacuation, or mechanical or hydraulic compression. In other embodiments the members may be initially provided or formed in a first configuration whereby inflation deforms the members to assume a new, second configuration. The wall of the chambers may comprise living or plastic hinges, or may be otherwise configured to deform in a predictable or desirable manner. The walls may be adapted to be more readily deformed from a retracted configuration to an extended configuration, the walls resisting subsequent deformation to the retracted configuration. This may be achieved by work-hardening, or by the form of the walls.

The chambers may be formed by members cooperating with the base pipe, for example an arcuate elongate member which is sealed to the base pipe along its edges. Such an elongate member may encircle the base pipe to create a continuous or non-continuous ring-shaped chamber. Alternatively, such an elongate member may extend axially along the base pipe, parallel to or inclined to the base pipe axis. The edges or ends of such elongate members may be dimensioned or configured to provide a substantially constant wall thickness or external dimension, or to minimise end effects.

The chamber walls may be formed of a single or homogenous material or may comprise layers or laminates of different materials. For example the chamber walls may comprise a first material to provide selected structural properties and a second material to provide selected fluid retention properties. Alternatively, or in addition, the walls of the chamber may be defined by sections of different materials or sections having different material properties, for example sections of relatively ductile material, to facilitate bending or other deformation, and other sections of relatively hard material for abrasion resistance.

The chambers may extend axially along the base pipe. Alternatively, or in addition, the chambers may extend circumferentially around the base pipe, for example the chambers may have a helical form or form rings.

The chambers may be spaced apart, may be directly adjacent or abutting, or may overlap. Where chambers overlap, overlapping portions may be formed to ensure that the chambers collectively describe a substantially circular form.

The chambers may be configured to be capable of providing an excess degree of diametric expansion. Thus, in a downhole environment, the chambers may provide support for elements intended to be radially translated into contact with the surrounding wall of a drilled bore. The bore will be of a predetermined diameter for much of its length, but some portions of the bore wall may be irregular or enlarged. The chambers may be configured to be capable of providing a degree of expansion beyond that required to obtain contact with the bore wall of said predetermined diameter, such that the bore wall contact may be maintained in the larger diameter portions of the bore. This capability is sometimes referred to as compliance, and assists in, for example, preventing collapse of the otherwise unsupported wall at said larger diameter portions of the wall.

The chambers may be deformed by any appropriate means. Typically, the chamber may be inflated using any appropriate fluid or flowable material, or by a solid material such as a swelling elastomer. An inflation liquid may be utilised, and the liquid may be incompressible. In other embodiments a compressible fluid or a flowable powder or granular material may be utilised. Some embodiments may utilise a multiphase material to inflate the chambers. The inflation material may expand at least in part in response to an external stimulus, such as heat, or on exposure to another material, which may be an ambient material or may be a material which is specifically supplied or mixed with the inflation material.

The chambers may be inflated using a single inflation medium or mechanism, or may comprise a combination of, for example, chemical or mechanical expansion mechanisms.

A flowable inflation material may have a substantially constant form, or the form of the material may change over time. For example, the material may swell or foam or become more viscous or solidify within the chamber. A hardening material may be deformable in its hardened state, for example foam cement.

The material utilised to inflate the chambers may be retained in the chambers, or may be free to flow from the chambers subsequently. Valve arrangements may be provided to control the flow of fluid into or from the chambers. The valve arrangements may comprise one-way valves, which valves may be configured to permit inflation or deflation of the chambers. In certain embodiments the valves may open on experiencing a predetermined pressure, to permit a degree of deflation of the chambers on the material within the chamber experiencing an applied pressure, for example in response to the bore wall applying a predetermined load to the apparatus.

The chambers may be biased or otherwise adapted to assume a retracted configuration, which may be useful when locating the apparatus in a bore, or if it is desired to remove the apparatus from a bore.

The chambers may be adapted to retain the inflated configuration, even in the absence of inflating or supporting internal pressure. This may be achieved by appropriate material and configuration selection.

The material for inflating the chambers may be provided in any appropriate manner, for example by pumping a selected inflation material from surface, or by utilising fluid lying in the bore. In one embodiment, the interior of the chambers may be exposed to pipe pressure, while an external wall of the fluid chamber experiences lower annulus pressure. An elevated pipe pressure may be achieved by various means, for example by pumping fluid into a pipe string provided with a nozzle in the end of the string, or by pumping fluid into a closed string. Thus, by controlling the pressure differential it may be possible to control the inflation of the chambers. The inflation material may be able to flow into the chambers but not flow out of the chambers, or may only be able to flow out of the chambers through a choke or restriction, such that an elevated pressure may be created within the chamber.

The chambers may be inflated collectively, and to a common pressure. Alternatively, chambers may be inflated individually, and to different pressures. Thus, the form of the apparatus may be controlled or varied by controlling the inflation of individual chambers. This feature may also be employed to vary the pressure applied to the surrounding bore wall, such that different pressure forces may be applied to different axial locations or to different circumferential locations. These pressure forces may be maintained at a substantially constant level or may be varied to optimise reservoir production.

The apparatus may include or be adapted for cooperation with appropriate control lines, which may be hydraulic and/or electrical control-lines. The control lines may be utilised to manipulate or communicate with devices such as valves, or sensors.

The apparatus may include a sand control element, such as a filter screen. The sand control element may be located externally of the chambers and be supported by the inflated chambers. The filter may form an integral part of the pressure chamber or may act as an independent, floating element of the resultant assembly. In either integral or independent designs the filter may be protected by a shroud, if required. The mounting of the filter element may be such that the reservoir fluids do not enter the pressure chambers, but flow around them and enter the base-pipe through openings provided in the pipe. In an alternative design, the reservoir fluids can flow through the filter and enter the pressure chambers through one-way valves incorporated into the pressure chambers, thereby allowing the inflation of the chamber.

The apparatus may define a fluid flow path to permit fluid to flow from a surrounding fluid-bearing formation into or along the base pipe. The flow path may extend through or around the chambers.

The base pipe may be apertured along its length to permit passage of fluid, or may be apertured or otherwise define flow openings only at selected locations, facilitating control of fluid flow.

Contacting, adjacent chambers may be configured to permit fluid flow between the chambers, for example the chamber walls may be knurled or feature circumferential grooves.

The apparatus may include an inflow-controlling device such as valve, choke, labyrinth or orifice incorporated in the flow path of reservoir fluids between the wellbore and the base pipe.

The apparatus may comprise a sealing element. The sealing element may be located externally of the chambers and be adapted to be supported by the chambers. The sealing element may comprise any appropriate material, such as an elastomer. The apparatus may be adapted to provide sealing engagement with the wall of a drilled bore, or with the inner surface of larger diameter tubing. Thus, the apparatus may be utilised to provide zonal isolation, or to act as a packer. In addition, the apparatus may be used as a cement-retaining device on a casing shoe or as an open hole-sealing device around a multilateral junction.

The apparatus may comprise gripping members, such as slip rings having a surface of relatively hard material. The gripping members may be mounted on or otherwise operatively associated with deformable chambers, which may extend axially along the base pipe. Inflation of the chambers radially displaces the gripping members towards the surrounding wellbore or casing wall. The chambers may be configured to provide fluid passage between or around the inflated chambers to allow, for example, cement bypass during cementation of an assembly incorporating the apparatus. The apparatus may thus be utilised, for example, as a liner hanger with cement bypass.

A liner-mounted apparatus may comprise both a sealing element and gripping members. The gripping members may be extended to engage the wellbore or casing wall, such that the liner may be supported from the gripping members. Cement may then be circulated into the annulus, displaced fluid and cement flowing past the gripping members. The sealing element may then be actuated to seal the annulus. An appropriate running tool may supply inflation fluid to the chambers supporting the gripping members, and the running tool may subsequently be moved or reconfigured to inflate the chambers which actuate the sealing element.

The base pipe may be of any appropriate form, and may comprise a support frame or other form with a discontinuous wall, or may comprise a continuous tubular wall. The base pipe may be relatively rigid, and not intended for expansion, or may be adapted for expansion, for example by comprising a slotted wall, or being formed of relatively ductile material.

According to a further aspect of the present invention there is provided a downhole apparatus comprising a base pipe and at least one fluid pressure deformable chamber mounted thereon, the chamber having a plastically deformable wall, whereby, following inflation of the chamber and deformation of the chamber wall, the wall retains said deformation.

According to a still further aspect of the present invention there is provided a method of lining a bore, the method comprising:

providing downhole apparatus comprising a base pipe and at least one fluid pressure deformable chamber mounted externally thereon, the chamber having a plastically deformable wall; and inflating the chamber to plastically deform the chamber wall.

According to yet another aspect of the present invention there is provided subterranean fluid production apparatus configurable to support a wall of a bore and adapted to deform in response to a selected load applied by the bore wall and to maintain a predetermined radial load on the bore wall.

According to a related further aspect of the present invention there is provided a method of producing fluid from a subterranean reservoir, the method comprising:

providing subterranean fluid production apparatus in a bore and configuring the apparatus to support a wall of a bore; and permitting the apparatus to deform in response to a selected load applied by the bore wall while maintaining a predetermined radial load on the bore wall.

The load applied to the bore wall may be varied over time, for example to compensate for or in response to changing reservoir conditions. The apparatus may be adapted to deform in response to a single fixed load, or may be configured to deform in response to a load selected while the apparatus is located in the bore, or in response to different loads at different times, which different loads may be preselected or which may be selected by an operator, or by monitoring equipment, in the course of the production cycle.

The apparatus may be adapted to deform in response to a similar load irrespective of the direction or location of the load relative to the apparatus. Alternatively, the apparatus may deform in response to different loads, depending on the location of the load. For example, in a horizontal bore, the apparatus may resist deformation from a vertical load of a certain magnitude, but would permit deformation if a load of similar magnitude was applied horizontally.

The apparatus and method of these aspects of the invention may comprise one or more of the previously described aspects, or may have an alternative configuration.

The apparatus may comprise a deformable chamber, member or layer. The deformable chamber, member or layer may take any appropriate form, and may comprise an elastomeric or resilient material, or a crushable material.

The apparatus may comprise inflatable chambers. Analysis of analytical pressure tests on the chamber selected for use in the invention allows a graph to be constructed to show the radial displacement of the chamber for a given inflation pressure, where pressurised fluid is retained within the chambers. Similarly, analysis of analytical collapse testing of individual chamber designs shows the expected deformation of the chamber if there is no retained pressure.

The inflatable or otherwise deformable chambers may deform in a manner which substantially retains the outer curvature or form of the apparatus. This may be achieved by selecting an appropriate chamber wall configuration, for example inner wall portions of the wall may deform while the form of outer wall portions is retained. The wall thickness may vary, or selected sidewall portions may define living hinges.

According to an alternative aspect of the present invention there is provided a downhole apparatus for location in a bore which intersects a fluid-producing formation, the apparatus comprising a base pipe and a bore wall-supporting member mounted on the base pipe, the member having a first configuration and an extended second configuration, the bore wall-supporting member being configurable to provide a predetermined bore wall supporting force for a fluid-producing formation, whereby fluid may flow from the formation into the base pipe.

According to a related aspect of the present invention there is provided a method of supporting the wall of a bore which intersects a fluid-producing formation, the method comprising;

providing an apparatus comprising a base pipe and a bore wall-supporting member mounted externally on the base pipe;

locating the apparatus in a bore, intersecting a fluid-producing formation;

extending the bore wall-supporting member to provide a predetermined bore wall-supporting force for the fluid-producing formation, and permitting fluid to flow from the formation into the base pipe.

The bore wall supporting force may be a constant force, or may be varied over time. The bore wall supporting force may also be constant around the circumference of the bore or along the axis of the bore, or may vary. In contrast to prior art proposals for supporting bore walls, embodiments of the present invention permit an operator to provide a predetermined level of support for the bore wall with a view to optimising production level or life and while accommodating differences in, for example, vertical and horizontal stresses. With conventional expandable tubulars the operator has little if any ability to select or control a bore-wall supporting force. For slotted and solid-walled expandable tubing, the force used to expand the tubing is selected solely to deform the tubing, without reference to any resulting forces on the bore-wall. In fact slotted, and solid walled expandable tubing will recover elastically following expansion, such that any initial contact with the bore wall will be followed by a retraction of the tubing, creating a small gap or micro-annulus between the tubing and the bore wall.

Proposals have been made to coat packers in swelling elastomers, which will swell and exert a force on the bore wall after exposure to well fluids. The pressure applied on the bore wall will depend on a number of factors, including the composition of the elastomer and the degree of expansion of the elastomer necessary to achieve contact with the bore wall. However, the operator does not have the ability to vary or adjust the pressure applied to the bore wall, and the primary intention of the packer is to seal the bore chambers to prevent fluid migration along the annulus.

To best understand the advantages of apparatus made in accordance with aspects of the invention, one must first understand how a rock behaves in a borehole. Rocks that have not been drilled have internal stresses that can be resolved into three types; a vertical stress and two horizontal stresses, usually of unequal magnitude. When a wellbore is drilled through the rock, the stresses in the near wellbore area change and there is a redistribution of the virgin stresses. Drilling the borehole and removing the rock from the hole creates a stress anisotropy, resulting in compressive and tensile stresses around the wellbore face. Depending on the strength of the rock and changes in pore pressure, rock failure and sand production may result.

When a rock sample is strained in a testing machine, the load on the sample rises until the stress exceeds the uniaxial or unconfined compressive strength (UCS). The rock then breaks up and loses most of its load carrying capacity. If a rock sample is confined as it usually is in the Earth then its strength is much greater than the UCS. This is due to the grains of the rock being pushed together by the confining pressure and greatly increasing the frictional component of the strength. The confined strength is a function of the UCS and the confining pressure. The confined strength of a rock is proportional to the confining stress exerted on the rock and can be described by the Mohr-Coulomb failure curve for a particular rock. Initially, the greater the confining stress, the greater the confined strength a rock has before failure.

Reference is now made to FIG. 15 of the attached drawings (Reference: Ewy, R. T. (1998): Wellbore stability predictions using a modified Lade criterion SPE 47251), which shows the results of a number of triaxial tests on a medium strength outcrop sandstone. Seven tests were done at confining pressure up to 8000 psi. From such results, the applicant has identified that increasing the confining pressure on the rock around the wellbore will lead to an increase in the required failure stress of any given rock.

A borehole completion method that can actively exert a stress on the wellbore, such as provided by a number of the aspects of the present invention as described above, may be utilised to achieve this.

When a rock experiences stress it will undergo changes in its permeability. Reference is now made to FIG. 16 of the accompanying drawings (Reference: Jones, C. & Smart B., 2002, *"Stress induced changes in two-phase permeability."* SPE 78155-MS), which shows the changes in single and two-phase permeability for a medium strength sandstone undergoing deformations (dilatency or strain) up to and beyond failure. This type of sandstone has porosity in excess of 10% and will generally suffer permeability loss when exposed to external stress and dilatency. In such rocks the network of pores is fully connected and an increase in pore volume during dilatency has no effect on the permeability. Other processes such as the closure of pore throats, formation of finer grains and an increase in tortuousity cause a decrease in permeability.

There is an approximately 90% drop in permeability during failure. As the rock fails it "grows" or dilates. This dilatency is expressed as "strain" in FIG. 16. A rock with a high failure stress will undergo less change in permeability when exposed to a given, fixed external stress than a rock with a lower failure stress. It is therefore advantageous to increase the failure stress of the rock by applying a confining stress to it. Increasing the rock's confined failure strength will modify (reduce) its permeability loss when exposed to a given external stress.

Now consider the situation in a borehole. An unsupported borehole will experience increasing external stresses as the reservoir fluids are produced and the rock pore pressure decreases (depletion). This is because the rock pore pressure opposes the overburden pressure exerted by the rock above it. As reservoir fluids are produced and the pore pressure decreases, the external stresses acting on the borehole will increase and the permeability of the rock around the bore wall will also be modified, generally decreasing. Consider now a situation where an apparatus is placed into the borehole to support the bore wall. The greater the bore wall supporting stress, the greater the increase in the failure strength of the rock and the greater it ability to resist the increasing external stresses during depletion. Accordingly, the modification of the rock's permeability by the external stress will be different (reduced).

Any device that can exert a confining radial stress to the bore wall will increase the rock's failure strength and modify its permeability loss when exposed to a given external stress. The greater the confining radial stress, the greater the increase in rock failure strength and the less permeability will be lost for a given external stress.

Let us now consider the actual radial stresses required to expand prior art expandable tubes. In the case of slotted expandable tubulars, the radial expansion stress is of the order of 1 MPa (MegaPascal, equal to 145 pounds per square inch, psi). In the case of perforated solid walled expandable tubulars, the required radial stress is in the order of 10 MPa. The residual radial stress that is applied to the bore wall during expansion of these tubulars is significantly less than the radial stress required to expand them. Any residual stress is removed immediately from the bore wall following expansion. An example medium strength sandstone typically found in oil and gas reservoirs has an unconfined failure stress in the order of 100 MPa, and the levels of residual radial stress momentarily exerted onto the bore wall by these expandable tubulars during expansion is less than 10% of the failure strength of the rock. These momentary, small radial stresses will not improve the confined failure strength of the rock and cannot therefore significantly affect permeability changes in the rock during any subsequent dilatency. Because the radial stress is removed immediately following expansion, there is no resultant permanent increase in the confined strength of the rock and no ability to permanently modify the permeability changes with any subsequent dilatency.

GB2404683 describes a bistable expandable tubular used to exert an external radial force on the wellbore surface. The radial stress is said to help stabilise the formation, but the operator does not appear to have any ability to control or vary the radial stress, and any variation in wellbore diameter would result in variations in the radial stress experienced by the wellbore surface.

The radial stress exerted by the bi-stable expandable tubular is a function of the material, thickness and length of the longitudinal bars found in the bi-stable cell and by the radial displacement in which it is constrained. The designer of the bi-stable cell expandable tubular must choose the cell design so that the expansion stress is within the capability of the downhole assembly to activate it, that its radial reach allows it to be conveyed into the borehole at a size small enough not to get stuck, whilst providing sufficient radial growth to provide a level of support to the bore wall. It is not possible to pre-design the bi-stable cell expandable tubular so that it can provide a variable, pre-selected radial stress matched to the optimum requirements of a particular rock. Mechanical, operational and economic factors drive the design of such expandable tubulars. Bi-stable expandable tubulars provide a bore wall supporting stress similar to that required to expand a commercial slotted expandable tube, that is of the order of 1 MPa. Such a confining stress would lead to an increase in the confined rock strength of medium strength sandstone of approximately 1%. They therefore provide only very small increases in the confined strength of the rock with corresponding small changes to permeability loss during dilatency. These small changes to rock strength and permeability can only be achieved once during expansion and not modified over time.

The objective of aspects of the present invention is to apply an optimum, significant and variable bore wall-supporting stress that can significantly increase the confined failure strength of the rock around the bore wall and thereby significantly modify the permeability behaviour of the rock during dilatency under external stress. Unlike previously described arrangements, the radial stress applied by the apparatus is not solely a function of the design of the apparatus, or its expansion method. The radial stress exerted by apparatus made in accordance with selected aspects of the present invention can be varied at any time after installation by changes in fluid pressure. By way of example, the apparatus may contain a series of deformable chambers comprising nominal 2⅞ inch diameter steel tubes of 180 MPa tensile strength and of ⅛" wall thickness. The minimum burst yield stress for this pipe is 40 MPa. When inflated with fluid pressure, the apparatus is therefore able to exert radial stresses onto the bore wall of up to 40 MPa. The unconfined failure strength of typical medium strength sandstone is 100 MPa, but when constrained by a radial force of 40 MPa its failure strength will increase by approximately 300-400%. This resultant increase in rock failure strength will have a significant effect on permeability changes during rock dilatency, modifying and delaying its decrease when compared to a rock without a significant radial force.

A further advantage of this embodiment of the invention is that the radial stress can be changed at any time. Consider the case where a borehole is created and the strength of the rock around it is determined from data acquisition tools at a well site. The operator can select the optimum radial stress to be exerted by the apparatus to the bore wall based on the data gathered on the well site. If, at a later date, the operator wishes to change the radial stress on the bore wall, he can do so by changing the fluid pressure within the apparatus. If a borehole contains several rock types, then several sections of the apparatus can be inflated using differing fluid pressures to apply several differing stresses to each individual rock type. If a section of borehole contains differing rock types around its circumference, then the deformable chambers mounted around the apparatus can contain differing fluid pressures, each chamber providing a specific radial stress, optimised for the rock type in that particular bore wall segment. Such changes and optimization techniques are not possible with bi-stable expandable tubes. The radial stress capabilities of this embodiment of the invention are at least 40 times greater than that of a bi-stable cell based expandable tube.

Now consider a bore hole drilled through a rock whose porosity is less than 10%. Generally these rocks have pore networks that are poorly connected and have relatively low permeability when compared to rocks with porosities higher than 10%. Rocks whose porosity is lower than 10% will generally increase their permeability when exposed to external stresses during initial dilatency (Reference: Wong T. F. & Zhu W. (1999) Brittle faulting and permeability evolution: hydromechanical measurement, microstructural observation, and network modelling. *Faults and sub-surface fluid flow in the shallow crust* Geophysical Monograph 113, AGU), because the brittle fracturing of the rocks causes an increase in the limited pore network connection. However, excessive dilatency under increasing external stress can lead to crushing and a reversal (loss) of permeability.

An apparatus in accordance with an embodiment of the invention may be operated in a different mode that can take advantage of the increase in permeability of low porosity rocks during initial dilation. For example, consider a low porosity rock that has a failure strength of 30 MPa. If a borehole is drilled through such a rock, and a solid, non-deformable borehole support is placed against the bore wall and a 30 MPa external stress applied, the rock will fail and an increase in permeability will initially occur as a result of brittle fracturing. However, if the external stresses are increased, such as through a decrease in pore pressure, the rock will dilate until crushing occurs, the fracture and pore volume is decreased and the permeability will start to decrease. Aspects of the present invention may also be utilised to mitigate this problem, as described below.

Apparatus in accordance with embodiments of the invention can be configured to provide a starting threshold radial stress of 30 MPa to the bore wall. In its fully collapsed state, the same chamber can be configured to provide an opposing radial stress equal to the base pipe collapse pressure. This can be achieved by matching the collapse resistance of the deformable chambers to the failure strength of the rock, for instance by selecting the appropriate chamber material and wall thickness, or by filling the chambers with a compressible fluid that will provide increasing resistance during collapse of the chamber. When the rock fails and has a tendency to dilate, the deformable chamber will gradually deform above the threshold radial stress of 30 MPa. The rock will dilate, creating brittle fracture networks that connect the pores and an increase in permeability will result. Increasing external stresses would normally lead to crushing of the rock and a reversal of permeability, however, because the apparatus is able to deform with gradually increasing external stress, the rock is able to dilate, relieving bore wall stresses and maintaining them at levels just above the threshold radial stress of the chamber. This deformation of the chamber with continued dilation will maintain the brittle fracture state for longer, delaying the onset of crushing and permeability loss. Prior art expandable tubes do not offer pre-designed deformation behaviour that can be matched to the failure characteristics of the rock.

Thus, for low porosity rock, stressing the rock to an appropriate degree will induce failure and increase porosity. Subsequently, an increase in applied stress (due to decreasing pore pressure) is accommodated by deformation of the chambers, permitting a controlled degree of dilatency (and thus controlled "failure"). Throughout, the bore wall is experiencing a relatively high applied stress. This contrasts prior art bore wall support arrangement, for example a bistable tubular, in which the initial applied stress is very low, such that porosity is initially unchanged, and remains relatively low. However, as pore pressure falls, the rock will tend to crush and fail. In the absence of a relatively high applied stress from the tubular, this failure will be rapid and uncontrolled, and absent any controlled dilatency. The porosity of the failing rock might perhaps rise momentarily, but will then fall rapidly as the rock is crushed. Also, this crushing will not be associated with any dilatency that would tend to collapse the bistable tubular. With controlled dilatency as provided in accordance with aspects of the present invention, the general form or structure of the rock tends to be maintained, and thus strain or a loss in height of the formation translates to expansion into the bore. With uncontrolled crushing, the rock structure collapses, so there is no corresponding "expansion" of the rock into the bore.

The most appropriate formation supporting force may be determined from surveys or other methods of analysis, and as such may be predetermined before the apparatus is located in the bore. Alternatively, or in addition, the formation supporting force may be determined in response to formation production or other parameters.

The objectives of these aspects of the invention may be achieved using some of the apparatus and methods described above with reference to the other aspects of the invention. Other embodiments of the invention may comprise alternative apparatus, for example the provision of resilient members or layers on a base pipe, which will maintain a selected bore-wall supporting force, even when a supporting expandable pipe experiences elastic recovery.

To accommodate variations in wellbore diameter it is preferred that the apparatus used to provide the bore-wall supporting force is compliant, that is the apparatus has the ability to follow an irregular bore-wall surface while still maintaining a substantially constant bore-wall supporting force.

The selection of the appropriate bore-wall supporting force is believed to be critical in achieving maximum production. Formation permeability is a function of rock microstructures and their reaction to changes in triaxial stress and pore pressure. For example, sensitivity studies for the case of unconsolidated clastic formations indicate that relative variations as high as 18% in porosity and as high as 13% in permeability can ensue in the near-wellbore region due to induced borehole stresses. In consolidated clastic formations, permeability can reduce by over 50% up to the point of failure. Delaying the failure of the rock in the near-wellbore region can help maintain initial permeability levels.

The bore wall-supporting force may be increased or decreased during the life of a well in response to well parameters, with a view to optimising production. Where the apparatus features deformable chambers inflated to a pressure that exerts a radial stress onto the wellbore wall, the inflation pressure may be selected to provide a stress on the wellbore substantially equal to that exerted onto the wellbore face by the wellbore fluid hydrostatic head or mud overbalance, thereby maintaining the near wellbore rock stresses in a substantially fixed state during any subsequent change in wellbore pressure. Alternatively, the deformable chambers may be inflated to a pressure that exerts a radial stress onto the wellbore face greater than that exerted onto the wellbore face by the wellbore fluid hydrostatic head or mud overbalance, thereby increasing the porosity and permeability of the rock in the near wellbore region and maintaining those modified properties during any subsequent change in wellbore pressure.

Where inflatable chambers are utilised to control the formation supporting force, the inflation pressure may be varied to vary the formation supporting force. This may be achieved by using an intervention tool to increase or decrease the inflation pressure, by use of hydraulic control lines, or by utilising appropriate valving.

According to another alternative aspect of the present invention there is provided a downhole apparatus for location in a bore which intersects a fluid-producing formation, the apparatus comprising a bore wall-supporting member configurable to provide a predetermined bore wall supporting force for a fluid-producing formation, whereby fluid may flow from the formation into the bore.

According to another related aspect of the present invention there is provided a method of supporting the wall of a bore which intersects a fluid-producing formation, the method comprising:

providing an apparatus comprising a bore wall-supporting member;

locating the apparatus in a bore, intersecting a fluid-producing formation; and configuring the bore wall-supporting member to provide a predetermined bore wall-supporting force for the fluid-producing formation, and permitting fluid to flow from the formation into the bore.

The rate of fluid flow into the bore may be controlled by a backpressure-regulating device, such as an orifice, labyrinth, valve or similar apparatus.

The bore wall-supporting force may be selected to optimise fluid production. The bore wall-supporting member may be adapted to be deformed by the collapsing wellbore at a rate that produces the optimum permeability of the formation for the optimum production of reservoir fluids.

According to a still further aspect of the present invention there is provided a method of supporting the wall of a bore which intersects a fluid-producing formation, the method comprising providing a predetermined bore wall-supporting force for the fluid-producing formation, and permitting fluid to flow from the formation into the bore.

BRIEF DESCRIPTION OF THE DRAWINGS

These and other aspects of the present invention will now be described, by way of example, with reference to the accompanying drawings, in which.

DETAILED DESCRIPTION OF THE DRAWINGS

Figure 1:
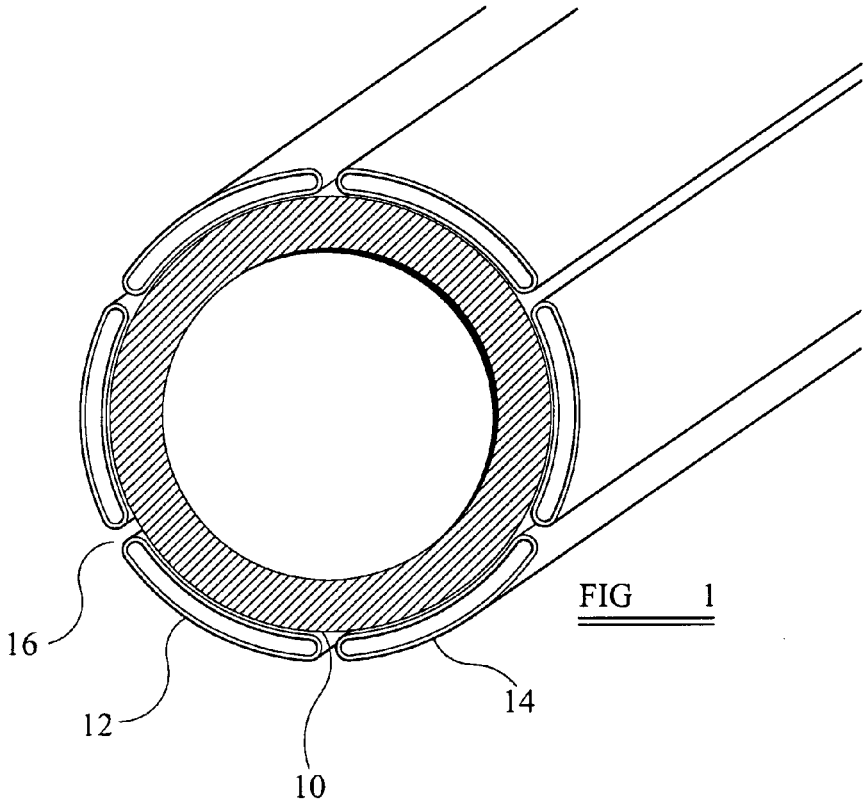
FIG. 1 is a sectional view of an apparatus in accordance with an embodiment of the present invention.

Reference is first made to FIG. 1 of the drawings, which is a sectional view of a downhole apparatus in accordance with a first embodiment of the present invention. The apparatus comprises tubing for use in lining drilled bores, such as are used to access hydrocarbon bearing formations. The apparatus comprises a rigid base pipe 10 and a plurality of non-concentric fluid pressure deformable chambers 12 mounted on the exterior of the pipe 10. The pipe 10 may comprise a conventional oil field tubular, which has been modified, as will be subsequently described. The chambers 12, six in this instance, are each defined by a tubular member 14. The members 14 are initially formed as cylindrical tubes, which are then flattened to the shallow oval form as illustrated in FIG. 1. The members 14 are also provided with a shallow curvature to match the circumference of the base pipe 10. The members 14 are welded to the pipe 10.

In the embodiment of FIG. 1, the members 14 are equally spaced around the circumference of the base pipe 10 with a small gap 16 therebetween. The members 14 extend axially along the base pipe 10, parallel to the base pipe axis.

Figure 2:
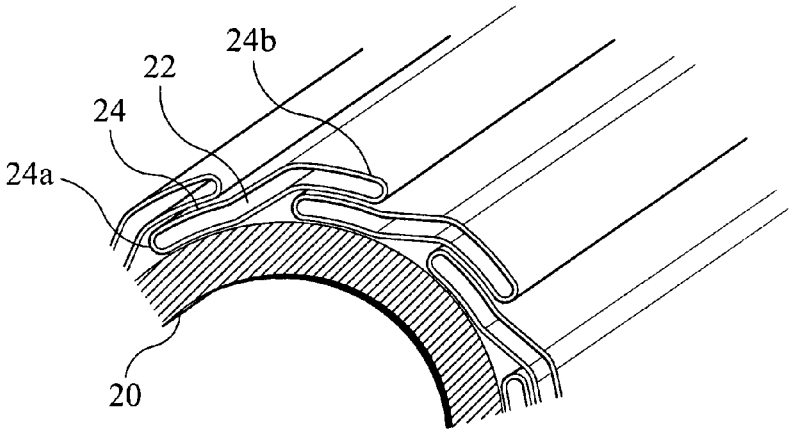
FIG. 2 is a sectional view of a segment of an apparatus in accordance with a second embodiment of the present invention.

FIG. 2 illustrates an alternative embodiment, in which a base pipe 20 provides mounting for a number of axially extending tubular members 24. As with the first embodiment, the members 24 each define a chamber 22. However, rather than being spaced apart, the members 24 overlap. In particular, one edge of each member 24*a* is fixed to the base pipe 20, while the other edge 24*b* is spaced from the base pipe 20, and lies over the edge of the next adjacent member 24.

Figure 3:
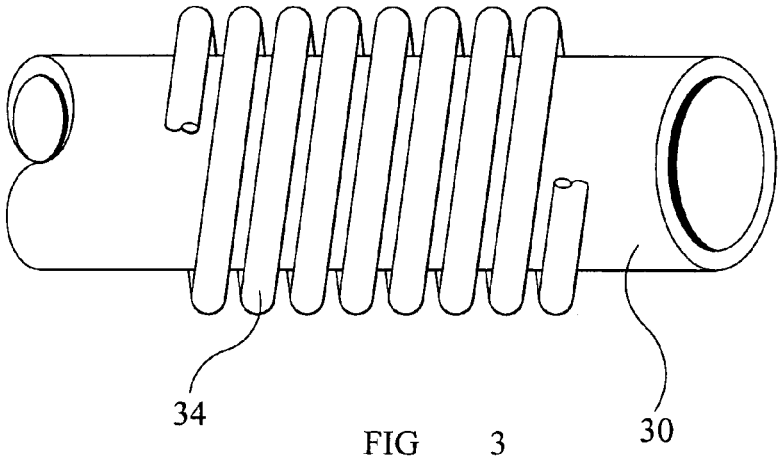
FIG. 3 shows an apparatus in accordance with a third embodiment of the present invention.

In the embodiments illustrated in FIGS. 1 and 2, the members 14, 24, extend axially of the respective base pipes 10, 20. An alternative embodiment is illustrated in FIG. 3 of the drawings, in which the chambers are defined by helically wound hollow members 34 mounted on a base pipe 30. The coil may be formed by a single continuous member 34, or may be formed by a plurality of members in multiple coils. The member 34 may define a single continuous chamber, or may define a number of discrete cells.

Figure 4A:
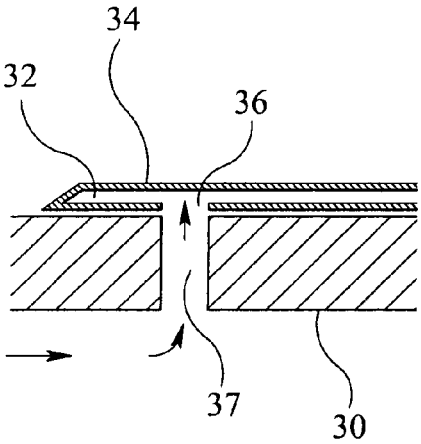
FIGS. 4*a* and 4*b* illustrate steps in the deployment of apparatus in accordance with an embodiment of the present invention.
Figure 4B:
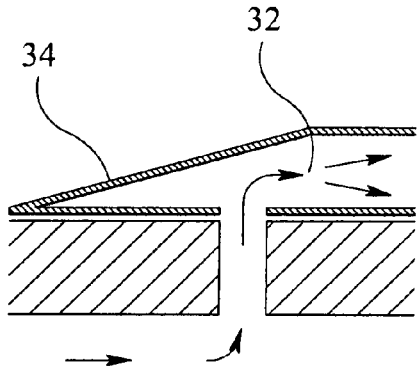

Reference is now made to FIG. 4*a* of the drawings, which illustrates a chamber 32, such as defined by the helical member 34 of FIG. 3, which may be inflated. FIG. 4*a* illustrates the chamber 32 in an initial, flattened form. The chamber 32 may have been fabricated in this form or may have been fabricated in another form and then compressed to the form as illustrated in FIG. 4*a*. It will be noted that the inner surface of the member 34 defines a flow port 36 which is in communication with a complementary flow port 37 formed in the base pipe 30. Thus, the chamber 32 is in fluid communication with the interior of the base pipe 30. When pressurised fluid is supplied to the interior of the base pipe 30, or there is an appropriate pressure differential between the interior of the base pipe 30 and the surrounding annulus, the helical member 34 will deform to enlarge the chamber 32, as illustrated in FIG. 4*b*, increasing the radial extent of the member 34, and increasing the diameter of the apparatus.

Figure 5:
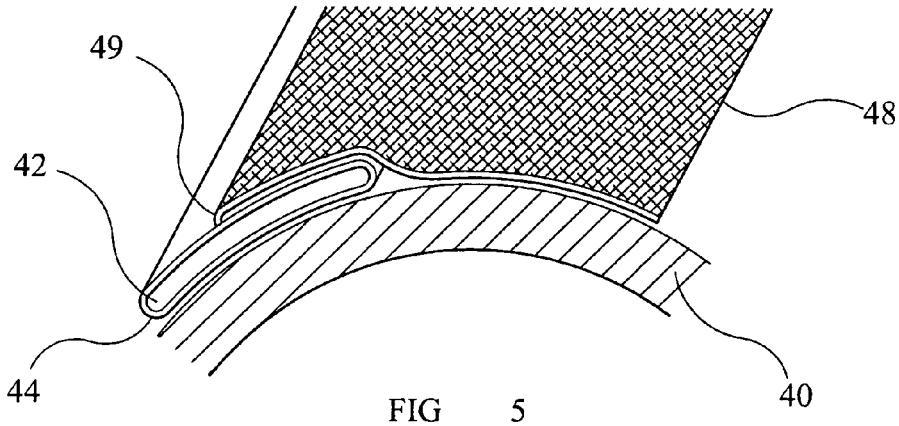
FIGS. 5 to 8 illustrate features of sand-control apparatus made in accordance with embodiments of the present invention.

Reference is now made to FIG. 5 of the drawings, which illustrates the apparatus in accordance with an embodiment of the invention for use in sand control applications. In this embodiment, as with the embodiments described above, a rigid base pipe 40 provides mounting for a number of axially extending tubular members 44, which define chambers 42. However, the members 44 (only one shown) do not form the outer surface of the apparatus. Rather, each member 44 supports a filter and drainage element 48. In the embodiment illustrated in FIG. 5, each filter element 48 is secured along one edge to the outer surface of a respective tubular member 44 by a weld bead 49. In this manner, the filter elements 48 form integral parts of the tubular members 44.

Figure 6:
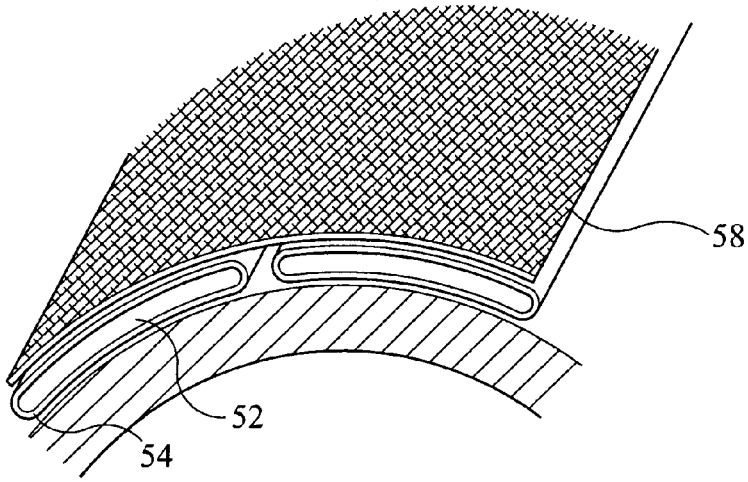

FIG. 6 of the drawings illustrates an alternative arrangement, in which a single expandable filter and drain element 58 is provided as an independent, floating element of the assembly, and extends around the entire apparatus. Alternatively, a series of overlapping filter elements may be provided, which elements slide over one another as the chambers 52 are inflated and the circumference described by the members 54, and the filter element 58, increases.

Figure 7:
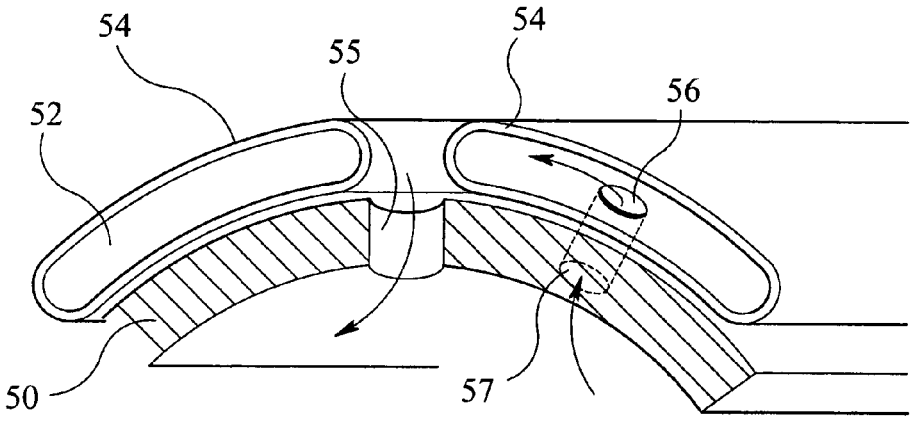

FIG. 7 of the drawings is an enlarged internal view of a segment of the apparatus of FIG. 6, and illustrates how well fluid may flow from a surrounding formation, through the filter element (not shown in FIG. 7), between the edges of adjacent tubular members 54 and through flow openings 55 in the base pipe 50. It will be noted that the flow ports 56, 57 which permit inflation of the members 54 are independent of the flow openings 55.

Figure 8:
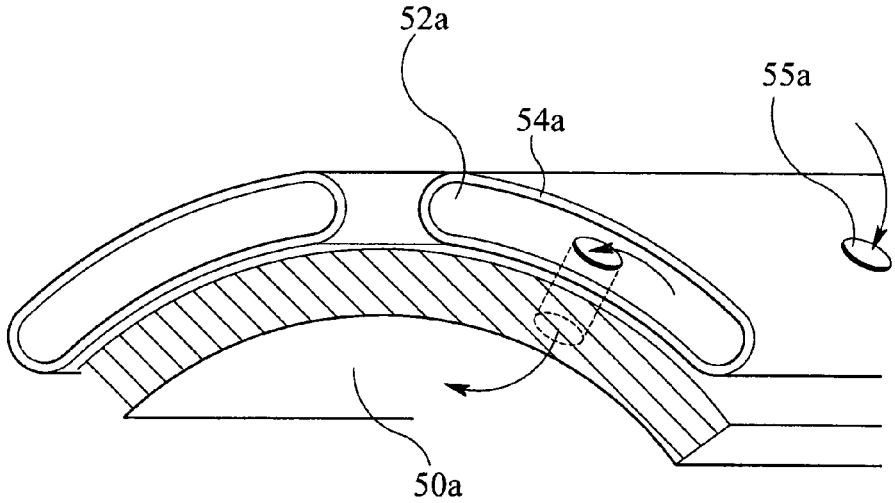

In an alternative embodiment, such as illustrated in FIG. 8 of the drawings, reservoir fluid may flow through the filter element (not shown), and then enter the pressure chambers 52*a* via openings 55*a* in the wall of the tubular members 54*a*, thereby permitting passage of the reservoir fluids into the base pipe 50*a*.

The members 54*a* are previously inflated to induce permanent plastic yield of the walls of the members 54*a*, by passing fluid into the chambers 52*a* through the flow port 56*a* communicating directly with the base pipe 50*a* and which is larger than the flow port 55*a*.

In use, the above described embodiments are adapted to provide wellbore support with minimal or zero intervention and without the need for either expensive service equipment or expensive downhole tools. The apparatus can be installed with a minimum of trained personnel. The apparatus does not require specialised base pipe material as there is no requirement to deform the base pipe. The absence of the requirement of slotting or perforation of the base pipe, other than the formation of flow passages, simplifies the production of the apparatus. Indeed, these embodiments may utilise standard oil field tubulars provided with standard oil field connections for economy and strength. The arrangement for achieving the diametric expansion of the apparatus may accommodate very high levels of bore hole irregularity, maximising the potential for full wellbore support over the entire well length. If desired, the wellbore support pressure provided by the inflated members may be modulated to match the support pressure that is optimum for a particular rock type or depletion regime, and may be varied around the circumference or axially of the apparatus by inflating different members to different pressures. Furthermore, it is possible to incorporate inflow control devices (ICD) into each section of apparatus. Such ICDs may be used to control the flow of reservoir fluid flow into the base pipe, or the flow of fluid into or from the inflatable members, and may control, for example, the pressure held within the tubular members with reference to the inflow pressure of the reservoir fluid. Control of such ICDs, and indeed any other devices mounted in or on the string, may be achieved using hydraulic or electric control lines, which may be readily accommodated by appropriate configuration of the tubular members. For example, inflatable members may be spaced apart about the base pipe to allow a control line to be run between adjacent members. The control lines are then protected beneath the filter element, and any protective shroud that is placed around the filter element.

As noted above, the apparatus may utilise retained inflation pressure to control the support of the wellbore face. Alternatively, reliance may be placed on the collapse resistance of the deformed chamber if, for example, inflation of a metal tubular member induces plastic deformation of the chamber and induces permanent yield. If desired, different tubular members may have different characteristics, for example, thicker or thinner walls or walls of different materials, such that the different members will inflate or collapse under different conditions. Thus, it is possible for the operator to control the manner in which a chamber will collapse in response to pressure applied by the wellbore face, which pressure will vary with depletion of the reservoir and the resulting changes in rock stresses around the wellbore.

One primary advantage of utilising independent pressure chambers formed by members having walls formed of a ductile, formable material, such as steel, is that the members will not deflate, or completely lose support to the formation, if the inflation pressure is lost. By way of comparison, EXP completions are known to start to deform when the external reservoir stresses exceed 150 psi for slotted types and 1200 psi for perforated types. Thus, the pressure applied by the EXP completions to support the wellbore face is determined solely with reference to the completion construction, and with no reference to optimising production. In accordance with selected aspects of the present invention, the pressure applied to the wellbore face can be controlled and production thus optimised.

A specific, non-limiting, specification for an embodiment of the present invention is set out below.

| | |
|---|---|
| Basepipe | 6⅝" 20 lbs/ft, L80 grade, premium thread |
| Pressure Chambers | 6 x formed 2⅜" sch 5, X52 grade pipes |
| Chamber x-section | Approx 88 m × 8 mm |
| Chamber arrangement | Non-overlapping |
| Drainage Layer | 2 mm nominal thickness |
| Filter | 2 mm thick Dutch Twill Weave, 316L grade |
| Shroud | 2 mm thick Perforated plate |
| Overall assembly ID | 6" |
| Overall assembly OD | 7¾" (including fabrication tolerances) |
| Assembly OD range | 7¾"-11" |

It will be noted that such an apparatus utilises existing materials, and thus would be relatively inexpensive to fabricate. It is further notable that the apparatus, once the chambers have been inflated, may describe an outside diameter in the range of 7¾ inches to 11 inches. This demonstrates the ability of embodiments of the present invention to accommodate relatively wide variations in the borehole wall configuration.

In addition to use in sand control applications, embodiments of the present invention may also be utilised in zonal isolation devices, where the chambers are integrated within or support a sealing element rather than a filter element. In such an apparatus, a base pipe carrying inflatable tubular members may be coated with a deformable, sealing material, such as rubber, or another elastomer. On inflation, the members increase the diameter described by the sealing element. By retaining pressure within the inflated members, the operator may ensure a constant stress is applied to the wellbore face, thereby ensuring a competent seal between the assembly and the wellbore.

In addition to providing an arrangement adapted to seal with the wellbore face, the apparatus may also be utilised to provide sealing engagement with, for example, existing casing, and thus act as a packer. Such a packer may take a similar form to the embodiment described above, or may utilise chambers formed in a different manner, as will now be described with reference to FIGS. 9*a* to 9*d* of the drawings. In this embodiment, an arcuate member 64 is formed into a ring, with the ends of the member 64 overlapping, and the ring placed around base pipe 60. On experiencing elevated internal pressure the member 64 tends to straighten and describe a larger diameter.

The overlapping ends of the members may be formed with a thinner wall than the non-overlapping portions such that the member 64 describes a circumference substantially circular in cross-section. The outer end portion of the member 64 may be further tapered to minimise any "end effects".

The member 64 is encased in a suitable sealing material, such as an elastomer band, such that on inflation of the member 64 the outer diameter of the sealing element is increased.

Other embodiments of the present invention may be utilised to form a liner hanger, that is an arrangement which is used to allow a string of tube to be suspended from an existing larger diameter string of tubing, such as existing casing.

Figure 10:
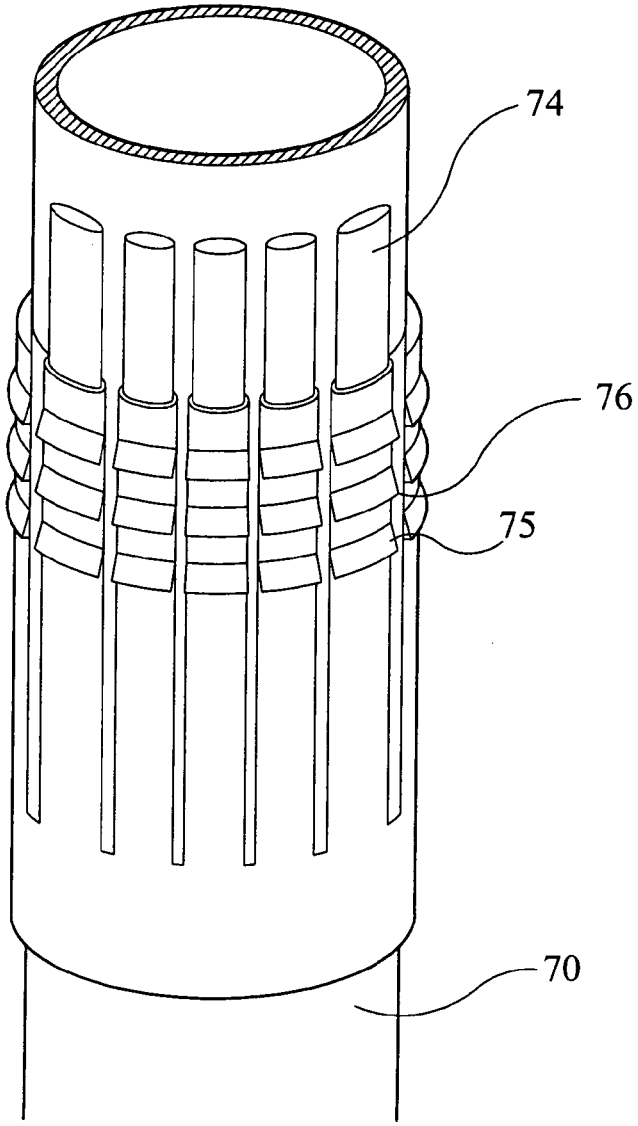
FIG. 10 shows a liner hanger made in accordance with an embodiment of the present invention.

Such an apparatus is illustrated in FIG. 10 of the drawings. In this apparatus, a rigid base pipe 70 provides a mounting for a plurality of axially extending tubular members 74. Gripping members 75 which collectively define slip rings 76, are mounted on or located externally of the members 74. The outer surfaces of the slip rings 76 are provided with coatings of suitable hardened material. In this embodiment the gripping members 75 comprise spring fingers of a collet.

On the member 74 being inflated, the gripping members 75 are radially displaced towards the surrounding wellbore or casing wall, engaging the surrounding wall and thereby holding the assembly firmly in place.

Figure 9:
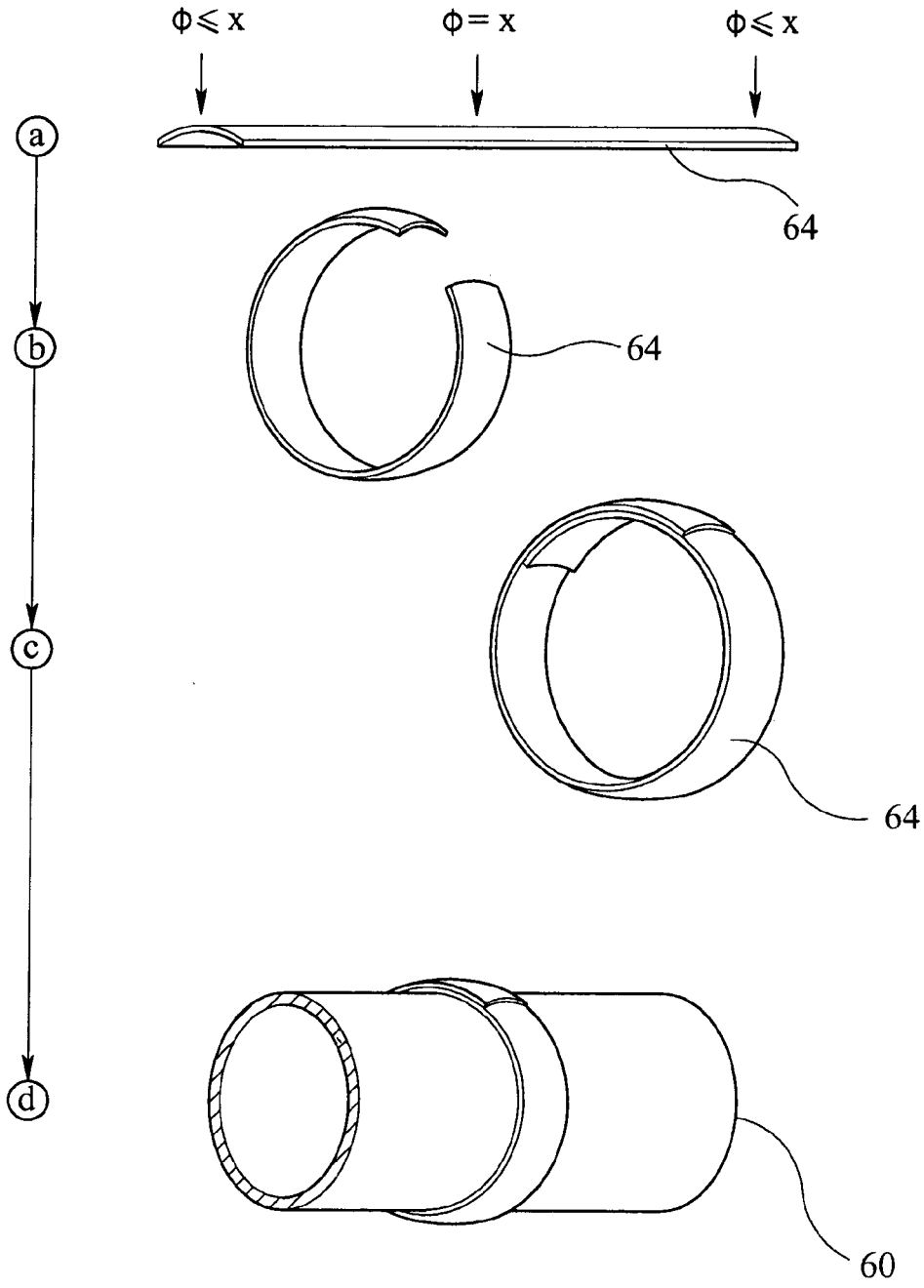
FIGS. 9*a* to 9*d* illustrate steps in the manufacture of an apparatus in accordance with an embodiment of the present invention.

In an alternative embodiment, a member 64 such as illustrated in FIG. 9 may be utilised to support a slip ring.

As noted above, apparatus made in accordance with embodiments of the present invention is capable of providing significant diametric expansion. Thus, prior to inflation of the members 74, a significant gap may exist between the apparatus and a surrounding casing, facilitating cement bypass during cementation operations. Alternatively, even if the members 74 have been inflated, the members may be circumferentially spaced apart, permitting cement bypass between the actuated portions of the slip ring 76.

Such a liner hanger assembly may also be combined with a packer such as described above. The packer and liner hanger apparatus may be provided in a single section of base pipe and may be actuated simultaneously, by simultaneous inflation of the appropriate tubular members, or may be actuated separately. For example, an assembly-running tool may first communicate inflation pressure to the liner hanger tubular members, and then move to supply pressure to the packer members. Alternatively, the tubular elements may be provided with inflation valves which open in response to different trigger pressures, such that a lower, first pressure will inflate the members which set the liner hanger, and a higher, second pressure will inflate the members which actuate the packer.

Reference will now be made to FIGS. 11 to 14 of the drawings, which illustrates different methods for actuating apparatus in accordance with embodiments of the present invention, and in particular the methods by which the tubular members may be inflated.

Figure 11:
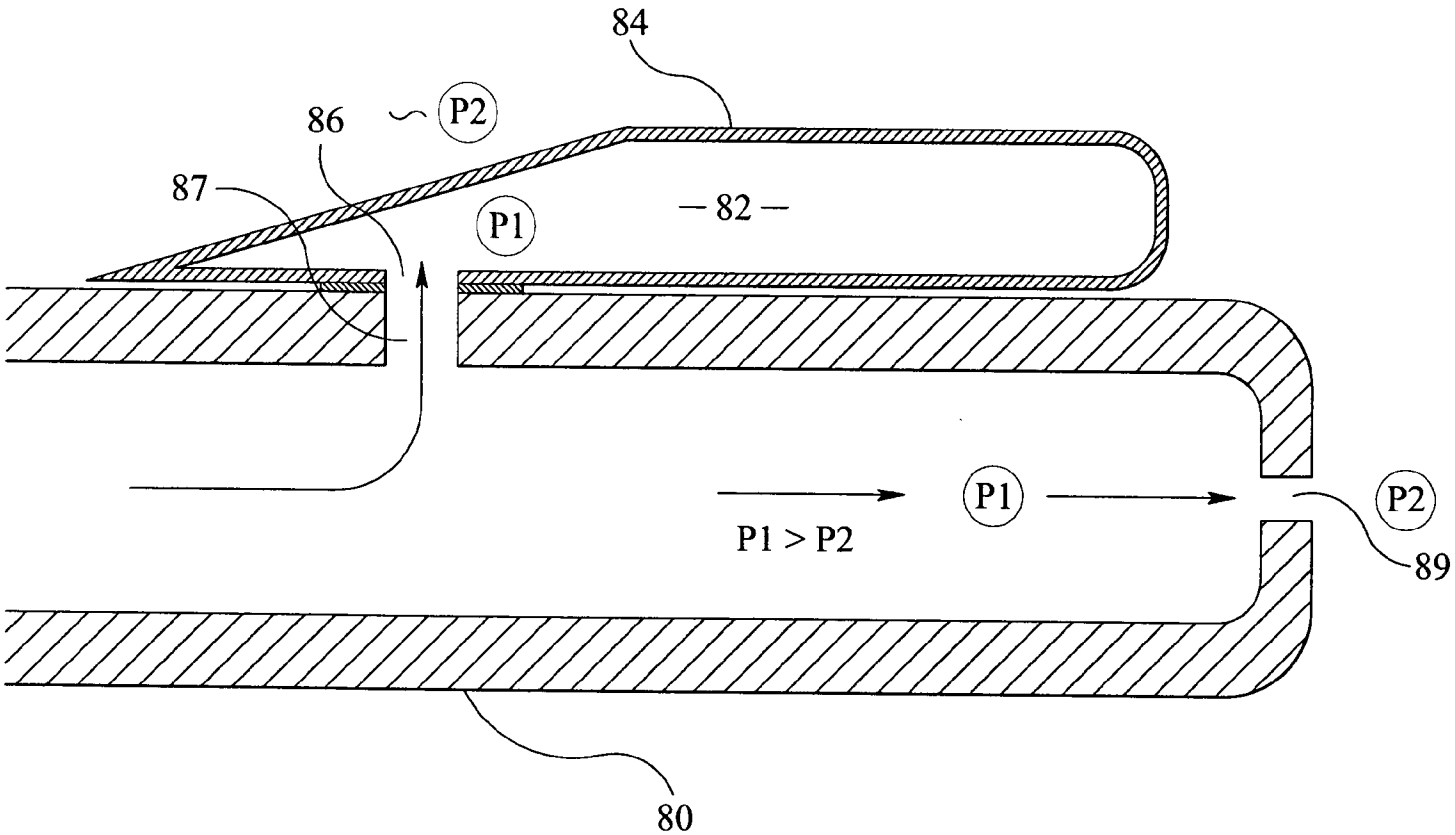
FIGS. 11 to 14 are sectional views of different arrangements for inflating chambers of apparatus made in accordance with embodiments of the present invention.

Reference is first made to FIG. 11 of the drawings, which illustrates an inflatable member 84 mounted on a base pipe 80, aligned flow ports 86, 87 between the member 84 and the base pipe 80 forming a single interface between the interior of the base pipe 80 and the chamber 82 defined by the member 84. In the embodiment illustrated in FIG. 11, a differential pressure a created between the interior of the base pipe 80 and the surrounding annulus by providing a restriction, such as a nozzle 89, at the lower end of the base pipe 80 and pumping fluid into the base pipe 80. Thus, the annulus experiences a lower fluid pressure (P2) than the interior of the base pipe 80 and the chamber 82 (P1), such that the member 84 will inflate.

Figure 12:
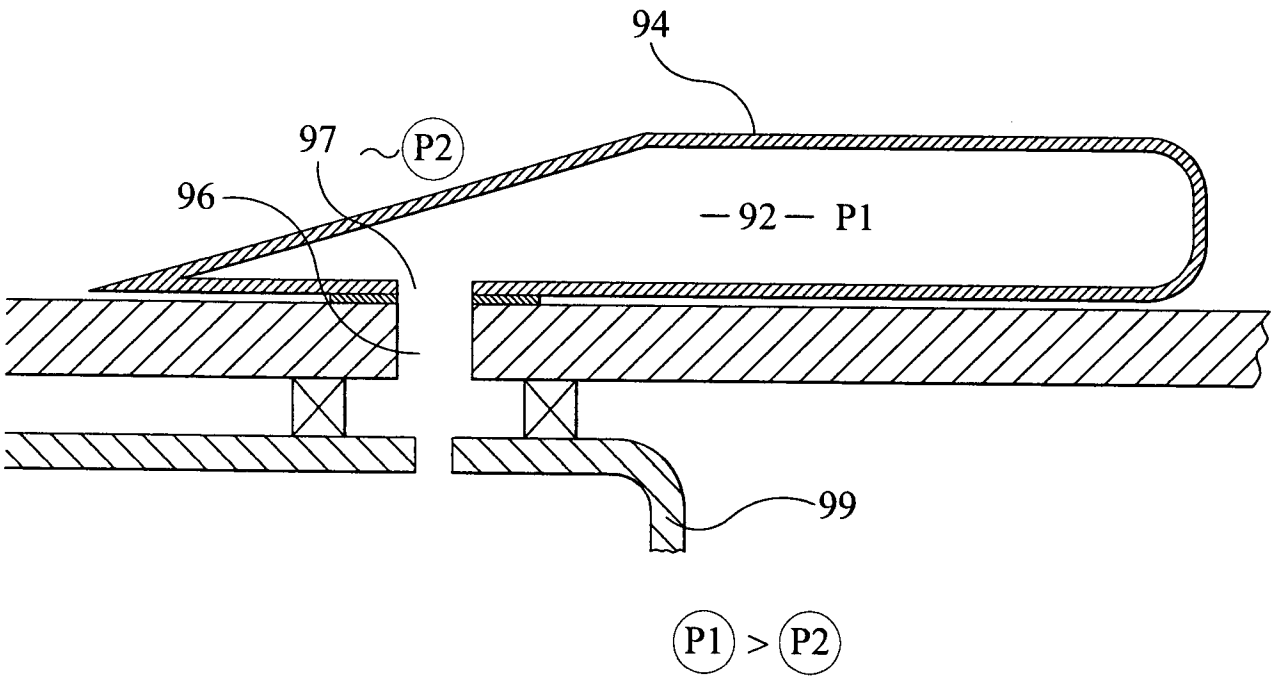

A similar effect may be achieved by use of a selective fluid-diverting tool 99, as illustrated in FIG. 12 of the drawings. The tool is placed in communication with the flow ports 96, 97 and a static column of fluid in the device 99 pressured. This pressure is communicated to the chamber 92, and thus inflates the tubular member 94.

Figure 13:
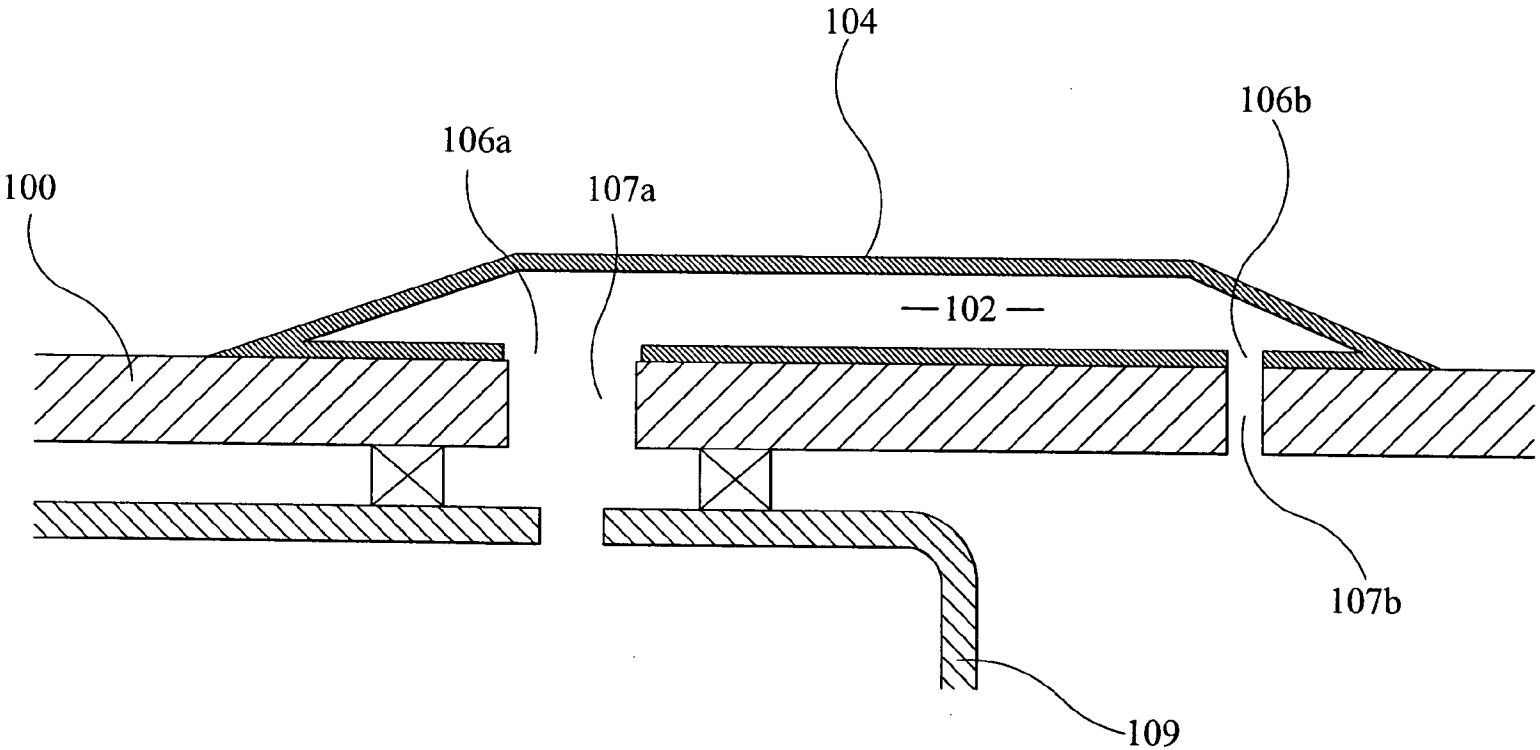

FIG. 13 of the drawings illustrates an alternative arrangement, in which a pair of flow ports 106*a*, 107*a* and 106*b* and 107*b* are provided between the base pipe 100 and the chamber 102 defined by the tubular member 104. However, the second pair of flow ports 106*b* 107*b* are smaller than the first pair 106, 107*a*, thus creating a restriction. If a diverter tool 109 is utilised to force pressurised fluid through the chamber 102, a differential pressure is created between the chamber 102 and the annulus resulting in deformation.

Figure 14:
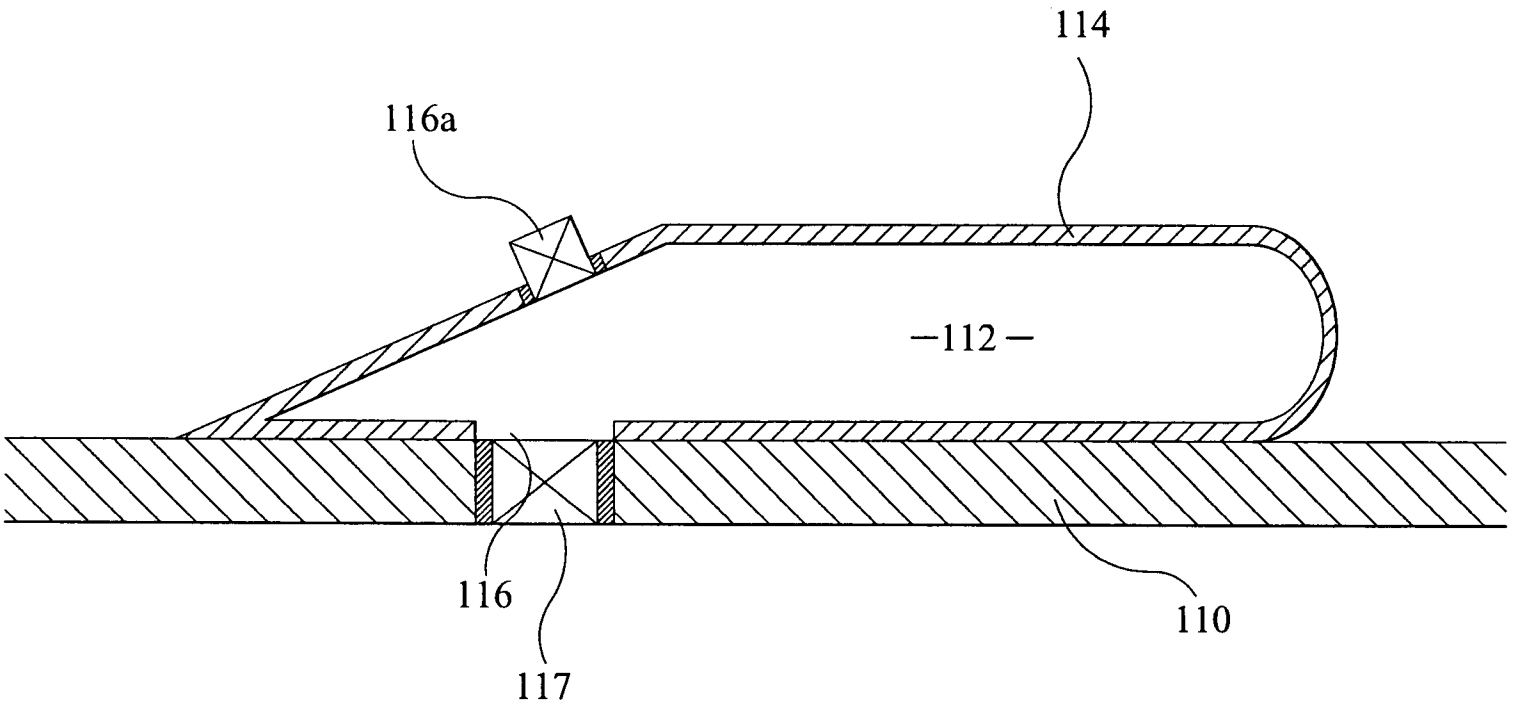
Figure 15:
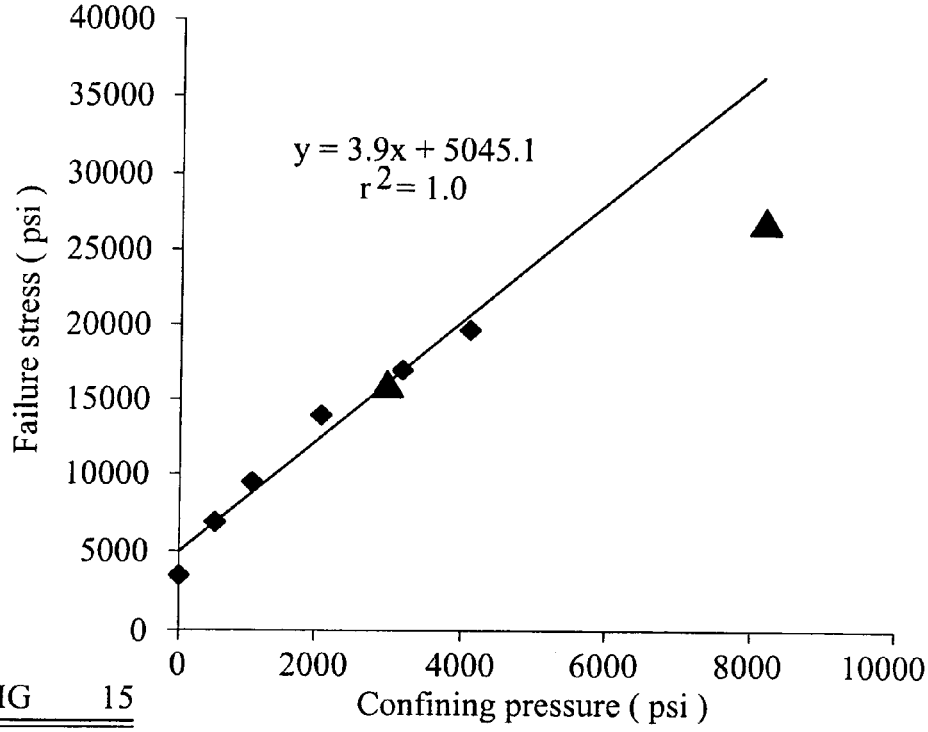
FIG. 15 is a graph illustrating variation of failure strength of a rock sample with confining pressure.
Figure 16:
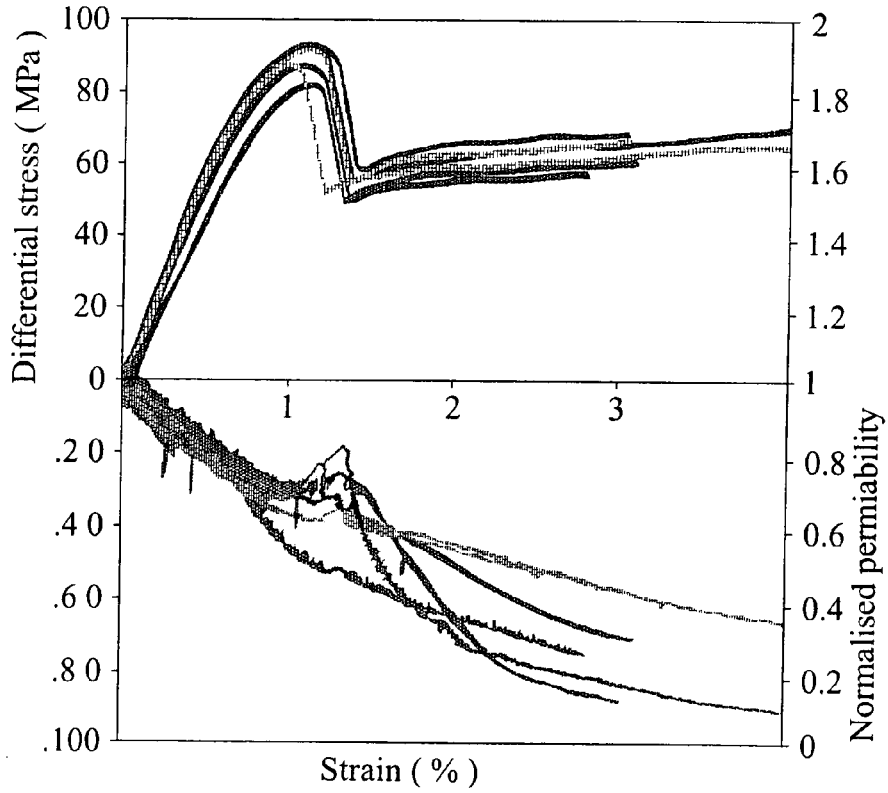
FIG. 16 is a graph showing changes in single and two-phase permeability for a medium strength sandstone undergoing deformations (dilatency or strain) up to and beyond failure.

A still further arrangement is illustrated in FIG. 14 of the drawings, where a pressure regulating valve is provided in the flow ports 116, 117, providing fluid communication between the interior of the base pipe 110 and the chamber 112 defined by the tubular member 114. Also, a flow port 116*a* is provided on an external wall of the tubular member 114, and is similarly equipped with a pressure-regulating valve.

Such pressure regulating valves may be utilised to control the pressure at which the member 114 is inflated and thus deformed, the pressure at which the inflated chamber 112 is vented, or indeed any combination of inflation or venting pressures.

The invention claimed is:

1. A downhole apparatus for location and installation in a bore which intersects a fluid-producing formation, the apparatus comprising:

a base pipe;

an expandable sand screen; and a bore wall-supporting member mounted on the base pipe and having a plurality of non-concentric fluid pressure deformable chambers mounted between the base pipe and the sand screen and extending axially along the base pipe, the chambers being inflatable to expand the sand screen such that the apparatus is configurable to provide and maintain a bore wall supporting force for a fluid-producing formation of at least 2 MPa, whereby fluid may flow from the formation into the bore and along a flow path extending through or around the chambers and into or along the base pipe.

2. A method of supporting the wall of a bore intersecting a fluid-producing formation, the method comprising:

providing and maintaining a bore wall-supporting force for the fluid-producing formation of at least 2 MPa by inflating a plurality of non-concentric axially extending fluid pressure-deformable chambers mounted externally of a rigid base pipe, and permitting fluid to flow from the formation into the bore and along a flow path extending through or around the chambers and into or along the base pipe, wherein the bore wall-supporting force is selected to optimize fluid production.

3. A method of conditioning a well bore extending through a rock formation having a first permeability adjacent to a bore wall, the method comprising applying a radial force to the bore wall by inflating a plurality of non-concentric axially extending fluid pressure-deformable chambers mounted externally of a rigid base pipe to at least one of:

modify the permeability of the rock adjacent the bore wall;

change the permeability of the rock adjacent the bore wall to a predetermined higher second permeability; and maintain the permeability of the rock adjacent the bore wall as the pore pressure within the rock decreases wherein the force is selected to control dilatency of the rock as the pore pressure of the rock decreases.

4. A subterranean fluid production apparatus configurable to support a wall of a bore, the apparatus comprising a plurality of non-concentric axially extending fluid pressure-deformable chambers mounted externally of a rigid base pipe and the chambers being adapted to deform in a controlled manner in response to a selected load applied by the bore wall and to maintain a predetermined radial load on the bore wall, wherein the apparatus includes an expandable sand screen mounted externally of the plurality of non-concentric axially extending fluid pressure-deformable chambers.

5. A downhole apparatus for location and installation in a bore which intersects a fluid-producing formation, the apparatus comprising:

a base pipe; and a bore wall-supporting member mounted externally on the base pipe and having a plurality of non-concentric axially extending fluid pressure deformable chambers mounted externally on the base pipe, the chambers being inflatable such that the apparatus is configurable to provide and maintain a bore wall supporting force for a fluid-producing formation of at least 2 MPa, whereby fluid may flow from the formation into the bore and along a flow path extending through or around the chambers and into or along the base pipe, and wherein the bore wall-supporting member comprises an expandable sand screen mounted externally on the chambers.

6. A method of supporting the wall of a bore intersecting a fluid-producing formation, the method comprising:

providing and maintaining a bore wall-supporting force for the fluid-producing formation of at least 2 MPa by inflating a plurality of non-concentric axially extending fluid pressure-deformable chambers mounted externally of a rigid base pipe, and permitting fluid to flow from the formation into the bore and along a flow path extending through or around the chambers and into or along the base pipe, wherein the bore wall-supporting force is selected to increase permeability of rock adjacent the bore wall.

7. A method of supporting the wall of a bore intersecting a fluid-producing formation, the method comprising:

providing and maintaining a bore wall-supporting force for the fluid-producing formation of at least 2 MPa by inflating a plurality of non-concentric axially extending fluid pressure-deformable chambers mounted externally of a rigid base pipe, and permitting fluid to flow from the formation into the bore and along a flow path extending through or around the chambers and into or along the base pipe, wherein the bore wall-supporting force is selected to increase a confined rock strength by at least 2%.

8. A method of supporting the wall of a bore intersecting a fluid-producing formation, the method comprising:

providing and maintaining a bore wall-supporting force for the fluid-producing formation of at least 2 MPa by inflating a plurality of non-concentric axially extending fluid pressure-deformable chambers mounted externally of a rigid base pipe, and permitting fluid to flow from the formation into the bore and along a flow path extending through or around the chambers and into or along the base pipe, wherein the bore wall-supporting force is selected to increase a confined rock strength by at least one of 5%, 10%, 20%, 30%, 40% and 50%.

9. A method of supporting the wall of a bore intersecting a fluid-producing formation, the method comprising:

providing and maintaining a bore wall-supporting force for the fluid-producing formation of at least 2 MPa by inflating a plurality of non-concentric axially extending fluid pressure-deformable chambers mounted externally of a rigid base pipe, and permitting fluid to flow from the formation into the bore and along a flow path extending through or around the chambers and into or along the base pipe, and utilizing a back pressure-regulating device to control a rate of fluid flow from the formation into a base pipe.

10. A method of supporting the wall of a bore intersecting a fluid-producing formation, the method comprising:

providing and maintaining a bore wall-supporting force for the fluid-producing formation of at least 2 MPa by inflating a plurality of non-concentric axially extending fluid pressure-deformable chambers mounted externally of a rigid base pipe, and permitting fluid to flow from the formation into the bore and along a flow path extending through or around the chambers and into or along the base pipe;

wherein the bore wall supporting force is varied over time.

11. A method of supporting the wall of a bore intersecting a fluid-producing formation, the method comprising:

providing and maintaining a bore wall-supporting force for the fluid-producing formation of at least 2 MPa by inflating a plurality of non-concentric axially extending fluid pressure-deformable chambers mounted externally of a rigid base pipe, and permitting fluid to flow from the formation into the bore and along a flow path extending through or around the chambers and into or along the base pipe;

wherein the bore wall supporting force varies depending upon bore location.

12. A method of supporting the wall of a bore intersecting a fluid-producing formation, the method comprising:

providing and maintaining a bore wall-supporting force for the fluid-producing formation of at least 2 MPa by inflating a plurality of non-concentric axially extending fluid pressure-deformable chambers mounted externally of a rigid base pipe, and permitting fluid to flow from the formation into the bore and along a flow path extending through or around the chambers and into or along the base pipe; and determining a formation supporting force from the surveys before the apparatus is located in the bore.

13. A method of supporting the wall of a bore intersecting a fluid-producing formation, the method comprising:

providing and maintaining a bore wall-supporting force for the fluid-producing formation of at least 2 MPa by inflating a plurality of non-concentric axially extending fluid pressure-deformable chambers mounted externally of a rigid base pipe, and permitting fluid to flow from the formation into the bore and along a flow path extending through or around the chambers and into or along the base pipe; and determining a formation supporting force in response to formation production parameters.

14. A method of supporting the wall of a bore intersecting a fluid-producing formation, the method comprising:

providing and maintaining a bore wall-supporting force for the fluid-producing formation of at least 2 MPa by inflating a plurality of non-concentric axially extending fluid pressure-deformable chambers mounted externally of a rigid base pipe, and permitting fluid to flow from the formation into the bore and along a flow path extending through or around the chambers and into or along the base pipe; and increasing the bore wall-supporting force.

15. A method of supporting the wall of a bore intersecting a fluid-producing formation, the method comprising:

providing and maintaining a bore wall-supporting force for the fluid-producing formation of at least 2 MPa by inflating a plurality of non-concentric axially extending fluid pressure-deformable chambers mounted externally of a rigid base pipe, and permitting fluid to flow from the formation into the bore and along a flow path extending through or around the chambers and into or along the base pipe; and decreasing the bore wall-supporting force.

16. A method of supporting the wall of a bore intersecting a fluid-producing formation, the method comprising:

providing and maintaining a bore wall-supporting force for the fluid-producing formation of at least 2 MPa by inflating a plurality of non-concentric axially extending fluid pressure-deformable chambers mounted externally of a rigid base pipe, and permitting fluid to flow from the formation into the bore and along a flow path extending through or around the chambers and into or along the base pipe; and exerting a radial stress onto the wellbore wall substantially equal to that exerted onto a wellbore face by a wellbore fluid hydrostatic head or mud overbalance.

17. A method of supporting the wall of a bore intersecting a fluid-producing formation, the method comprising:

providing and maintaining a bore wall-supporting force for the fluid-producing formation of at least 2 MPa by inflating a plurality of non-concentric axially extending fluid pressure-deformable chambers mounted externally of a rigid base pipe, and permitting fluid to flow from the formation into the bore and along a flow path extending through or around the chambers and into or along the base pipe; and exerting a radial stress onto a wellbore face less than that exerted onto the wellbore face by a wellbore fluid hydrostatic head or mud overbalance.

18. A method of supporting the wall of a bore intersecting a fluid-producing formation, the method comprising:

providing and maintaining a bore wall-supporting force for the fluid-producing formation of at least 2 MPa by inflating a plurality of non-concentric axially extending fluid pressure-deformable chambers mounted externally of a rigid base pipe, and permitting fluid to flow from the formation into the bore and along a flow path extending through or around the chambers and into or along the base pipe;

wherein the bore wall-supporting force is predetermined, and wherein the predetermined bore wall-supporting force is selected to maintain a predetermined permeability of rock adjacent to the bore wall.

19. A method of supporting the wall of a bore intersecting a fluid-producing formation, the method comprising:

providing and maintaining a bore wall-supporting force for the fluid-producing formation of at least 2 MPa by inflating a plurality of non-concentric axially extending fluid pressure-deformable chambers mounted externally of a rigid base pipe, and permitting fluid to flow from the formation into the bore and along a flow path extending through or around the chambers and into or along the base pipe;

wherein the bore wall-supporting force is predetermined, and wherein the predetermined bore wall-supporting force is selected to maintain the initial formation permeability of rock adjacent to the bore wall.

20. A method of supporting the wall of a bore intersecting a fluid-producing formation, the method comprising:

providing and maintaining a bore wall-supporting force for the fluid-producing formation of at least 2 MPa by inflating a plurality of non-concentric axially extending fluid pressure-deformable chambers mounted externally of a rigid base pipe, and permitting fluid to flow from the formation into the bore and along a flow path extending through or around the chambers and into or along the base pipe;

wherein the bore wall-supporting force is predetermined, and wherein the predetermined bore wall-supporting force is selected to maintain a permeability greater than an initial permeability of rock adjacent to the bore wall.

21. A method of conditioning a well bore extending through a rock formation having a first permeability adjacent to a bore wall, the method comprising applying a radial force to the bore wall by inflating a plurality of non-concentric axially extending fluid pressure-deformable chambers mounted externally of a rigid base pipe to at least one of:

modify the permeability of the rock adjacent the bore wall;

change the permeability of the rock adjacent the bore wall to a predetermined higher second permeability; and maintain the permeability of the rock adjacent the bore wall as the pore pressure within the rock decreases, wherein the force is selected to increase a confining pressure on the rock around the wellbore and increase a confined rock strength thereof.

22. A method of conditioning a well bore, the method comprising:

deploying a sand screen in a wellbore extending through a rock formation; and configuring the sand screen by inflating a plurality of non-concentric axially extending fluid pressure-deformable chambers mounted between a rigid base pipe and the sand screen to provide a radial force against the bore wall, the force being selected to modify a permeability of the rock adjacent to the bore wall, wherein the sand screen is an expandable sand screen.

23. The method of claim 22, wherein the sand screen is capable of providing a degree of expansion beyond that required to obtain contact with the bore wall of the predetermined diameter, such that the bore wall contact may be maintained in the larger diameter portions of the bore.

* * * * *